US010864625B2

(12) United States Patent
Hanlon

(10) Patent No.: US 10,864,625 B2
(45) Date of Patent: Dec. 15, 2020

(54) SAWHORSE

(71) Applicant: JS Products, Inc., Las Vegas, NV (US)

(72) Inventor: Jared W. Hanlon, Las Vegas, NV (US)

(73) Assignee: JS Products, Inc., Las Vegas, NV (US)

( * ) Notice: Subject to any disclaimer, the term of this patent is extended or adjusted under 35 U.S.C. 154(b) by 166 days.

(21) Appl. No.: 15/831,927

(22) Filed: Dec. 5, 2017

(65) Prior Publication Data

US 2019/0168374 A1 Jun. 6, 2019

(51) Int. Cl.
*B65H 1/06* (2006.01)
*B25H 1/04* (2006.01)
*B25H 1/06* (2006.01)

(52) U.S. Cl.
CPC ..... *B25H 1/06* (2013.01); *B25H 1/04* (2013.01)

(58) Field of Classification Search
CPC ... B25H 1/06; B25H 1/04; B23Q 1/03; B23Q 1/25
See application file for complete search history.

(56) References Cited

U.S. PATENT DOCUMENTS 5,105,862 A * 4/1992 Skinner ..... B23D 47/025 144/286.1
5,960,904 A * 10/1999 Ullmann ..... E04G 3/26 182/45
6,681,895 B2 * 1/2004 Virtue ..... B25H 1/06 182/153
7,185,738 B1 * 3/2007 Clepper ..... B25H 1/06 182/155
9,221,168 B2 * 12/2015 Boyd ..... B25H 1/04
D842,015 S * 3/2019 Strempke ..... D6/684
10,252,410 B2 * 4/2019 Luis y Prado ..... B25H 1/14
2010/0288585 A1 * 11/2010 Katz ..... B25H 1/04 182/155

* cited by examiner

*Primary Examiner* — Tyrone V Hall, Jr.
*Assistant Examiner* — Makena S Markman
(74) *Attorney, Agent, or Firm* — Weide & Miller, Ltd.

(57) ABSTRACT

Various implementations described herein are directed to an apparatus having an elongated support with a recess. The apparatus includes multiple legs rotatably coupled to the elongated support so as to move between open and closed positions. The multiple legs collapse and retract from the open position to the closed position so as to nest within the recess of the elongated support. The multiple legs expand and deploy from the closed position to the open position so as to extend from the recess of the elongated support. The apparatus includes multiple arms rotatably coupled to the multiple legs so as to move between deployed and retracted positions. The multiple arms telescopically compress in a direction so as to slidably retract from the deployed position to the retracted position. The multiple arms telescopically expand in another opposite direction so as to slidably extend from the retracted position to the deployed position.

14 Claims, 13 Drawing Sheets

400C

400B

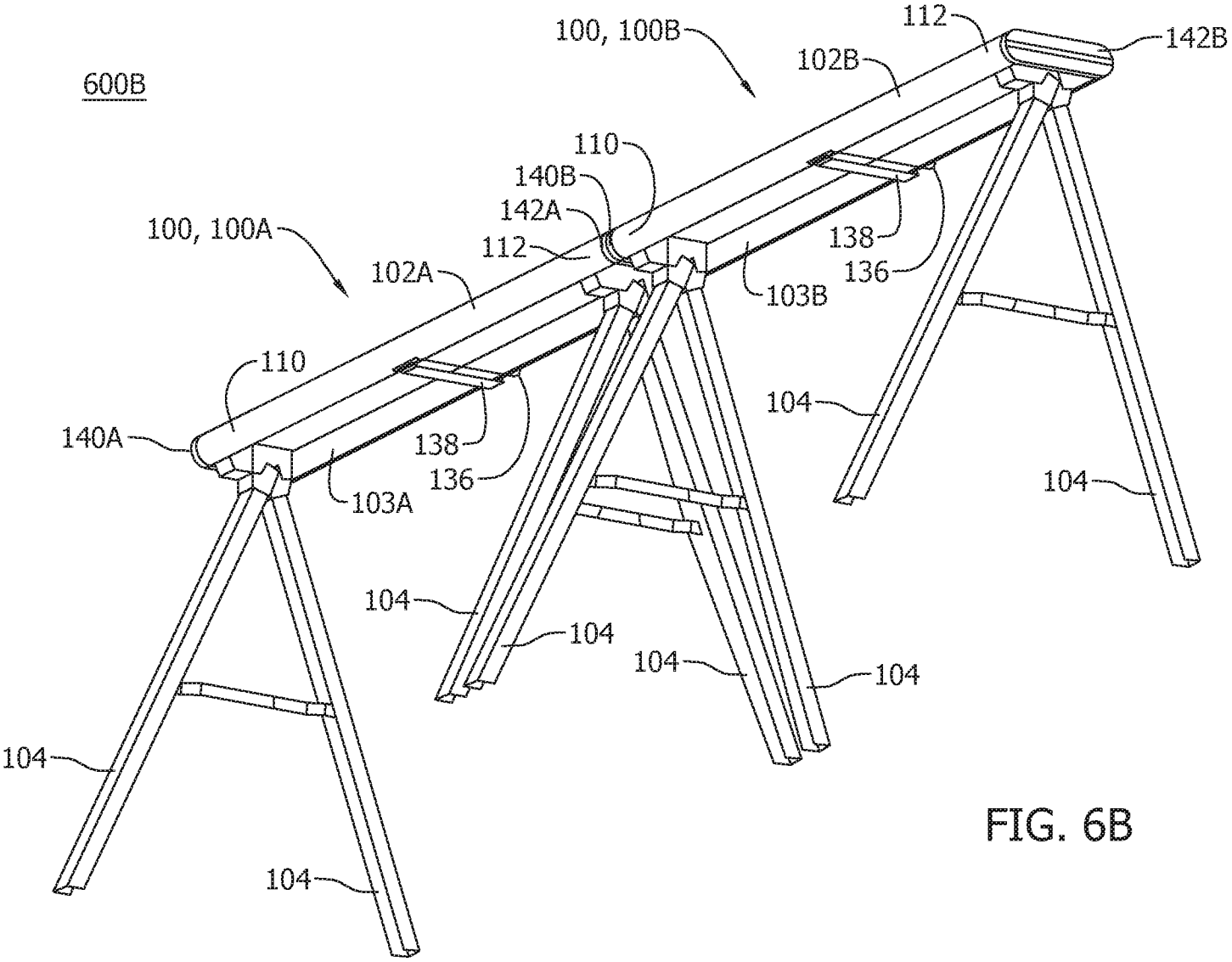
142B
112
102B
100, 100B
110
140B
142A
112
138
136
103B
104
104
104

SAWHORSE

BACKGROUND

This section is intended to provide information relevant to understanding various technologies described herein. As the section's title implies, this is a discussion of related art that should in no way imply that it is prior art. Generally, related art may or may not be considered prior art. It should therefore be understood that any statement in this section should be read in this light, and not as any admission of prior art.

Conventionally, a sawhorse refers to a horizontal beam having multiple leg members that serve to raise and support the beam at some height above ground level. The sawhorse is typically used to support the weight of a board or plank for any number of construction projects, such as, e.g., sawing, nailing, etc. In some cases, a pair of sawhorses spread apart by some distance may be used to support both ends of a board or plank. The sawhorse may be portable and thus designed to collapse and/or fold for transport and/or storage. The platform may be used as a scaffold or platform for tools.

BRIEF DESCRIPTION OF THE DRAWINGS

In order that the advantages of the embodiments of the disclosure are readily understood, a particular description of the embodiments briefly described herein are thus rendered by reference to various specific embodiments that are illustrated in the appended drawings. Understanding that these drawings depict only some embodiments and are not therefore to be considered to be limiting of scope, the embodiments are described and explained herein with additional specificity and detail through the use of the accompanying drawings, in which:

FIGS. 6A-6B illustrate various views of multiple apparatuses designed for use as conjoined sawhorses in accordance with embodiments of the present disclosure;

SUMMARY

Figure 1:
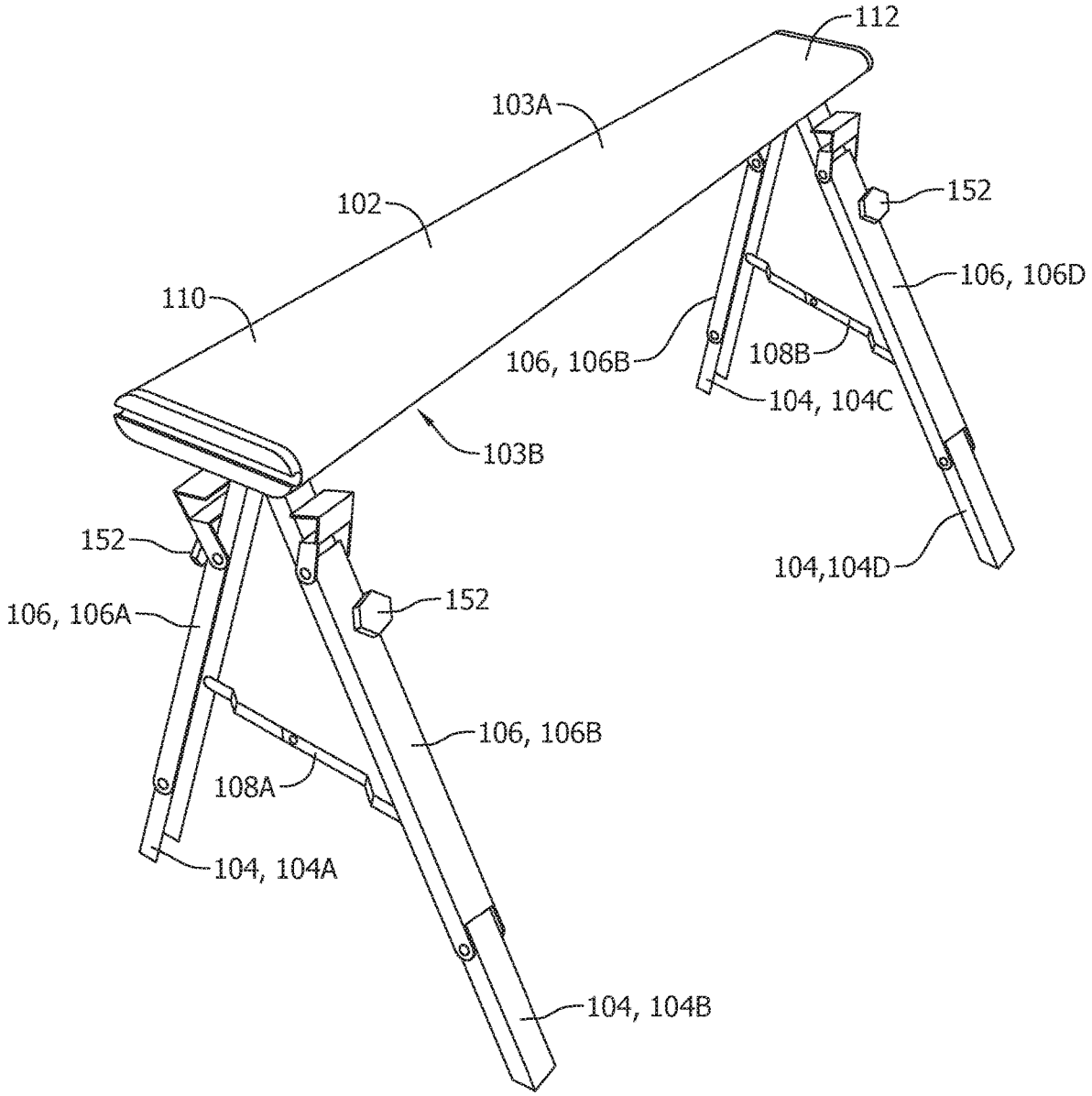
FIG. 1 illustrates an apparatus designed for use as a sawhorse in accordance with embodiments of the present disclosure.

Various embodiments of the disclosure provide for an apparatus having an elongated support member having a recess. The apparatus includes multiple leg members rotatably coupled to the elongated support member so as to move between an open position and a closed position. The multiple leg members collapse and retract from the open position to the closed position so as to nest within the recess of the elongated support member. The multiple leg members expand and deploy from the closed position to the open position so as to extend from the recess of the elongated support member. The apparatus includes multiple arm members rotatably coupled to the multiple leg members so as to move between a deployed position and a retracted position. The multiple arm members telescopically compress in a first direction so as to slidably retract from the deployed position to the retracted position. The multiple arm members telescopically expand in a second direction, that is opposite the first direction, so as to slidably extend from the retracted position to the deployed position.

Various embodiments of the disclosure provide for an apparatus embodied as a device or tool for supporting a tabletop. The apparatus includes a horizontal sawhorse beam having a recess formed therein. The apparatus includes a first pair of collapsible legs coupled to a first end of the horizontal sawhorse beam. The first pair of collapsible legs include a first pair of telescoping arms that extend outward to support the tabletop with clamps secured to the tabletop. The apparatus includes a second pair of collapsible legs coupled to a second end of the horizontal sawhorse beam. The second pair of collapsible legs include a second pair of telescoping arms that extend outward to support the tabletop with clamps secured to the tabletop.

Various embodiments of the disclosure provide for a method of fabricating or manufacturing a sawhorse. The method includes fabricating an elongated beam for the sawhorse, and the elongated beam includes a top-side with a flat supporting surface and a bottom-side with a recess formed therein. The method includes fabricating multiple legs for the sawhorse such that the multiple legs are rotatably coupled to the elongated beam so as to move between an open position and a closed position. The multiple legs collapse and retract from the open position to the closed position so as to nest within the recess of the elongated beam. The multiple legs expand and deploy from the closed position to the open position so as to extend from the recess of the elongated beam. The method includes fabricating multiple arms for the sawhorse such that the multiple arms are rotatably coupled to the multiple legs so as to move between a deployed position and a retracted position. The multiple arms telescopically compress in a first direction so as to slidably retract from the deployed position to the retracted position. The multiple arms telescopically expand in a second direction, that is opposite the first direction, so as to slidably extend from the retracted position to the deployed position.

DETAILED DESCRIPTION

Reference throughout this specification to "one embodiment," "an embodiment," or similar language means that a particular feature, structure, or characteristic described in connection with the embodiment is included in at least one embodiment of the present disclosure. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, structures, or characteristics of the disclosure may be combined in any suitable manner in one or more embodiments. In the following description, numerous specific details are provided to give a thorough understanding of embodiments of the disclosure. However, the disclosure may be practiced without one or more of the specific details, or with other methods, components, materials, and so forth. In other instances, well-known structures, materials, or operations are not shown or described in detail to avoid obscuring aspects of the disclosure.

The description of elements in each figure may refer to elements of proceeding figures. Like numbers refer to like elements in all figures, including alternate embodiments of like elements.

FIG. 1 illustrates a perspective view of an apparatus 100 designed for use as a sawhorse in accordance with embodiments of the present disclosure.

In reference to FIG. 1, the apparatus 100 may include an elongated support member 102 having a recess 103B. The elongated support member 102 may be embodied as a horizontal sawhorse beam having a top-side with a flat supporting surface 103A and a bottom-side with the recess 103B formed therein. The recess 103B may refer to an interior cavity formed within the elongated support member 102 with an aperture formed in a flat supporting surface of the bottom-side, e.g., as shown in FIGS. 2B, 3B. The apparatus 100 may also be referred to as a device or tool, including a multi-use device or tool. The recess 103B may also be referred to as a holding area or interior cavity.

Figure 3A:
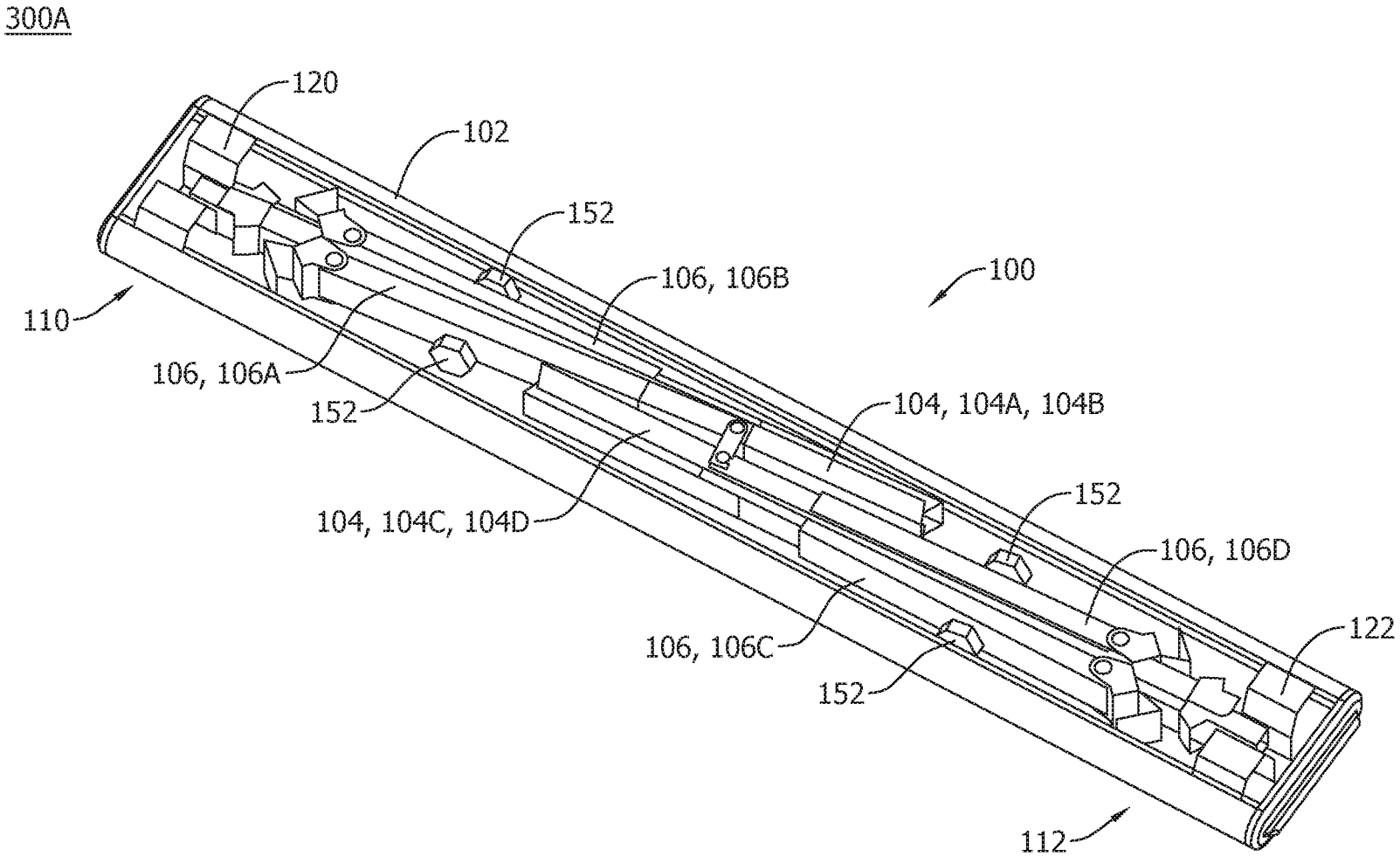
FIGS. 3A-3B illustrates various views of the apparatus designed for use as a sawhorse with nested legs in accordance with embodiments of the present disclosure.

The apparatus 100 includes multiple leg members 104 rotatably coupled to the elongated support member 102 so as to move (or rotate) between an open position (e.g., as shown in FIG. 1) and a closed position (e.g., as shown in FIGS. 3A, 3B). The multiple leg members 104 may collapse and retract from the open position to the closed position so as to nest (or fold) within the recess 103B of the elongated support member (e.g., as shown in FIGS. 3A, 3B). The multiple leg members 104 may expand and deploy from the closed position to the open position so as to extend from the recess 103B of the elongated support member 102 (e.g., as shown in FIG. 1).

Figure 2A:
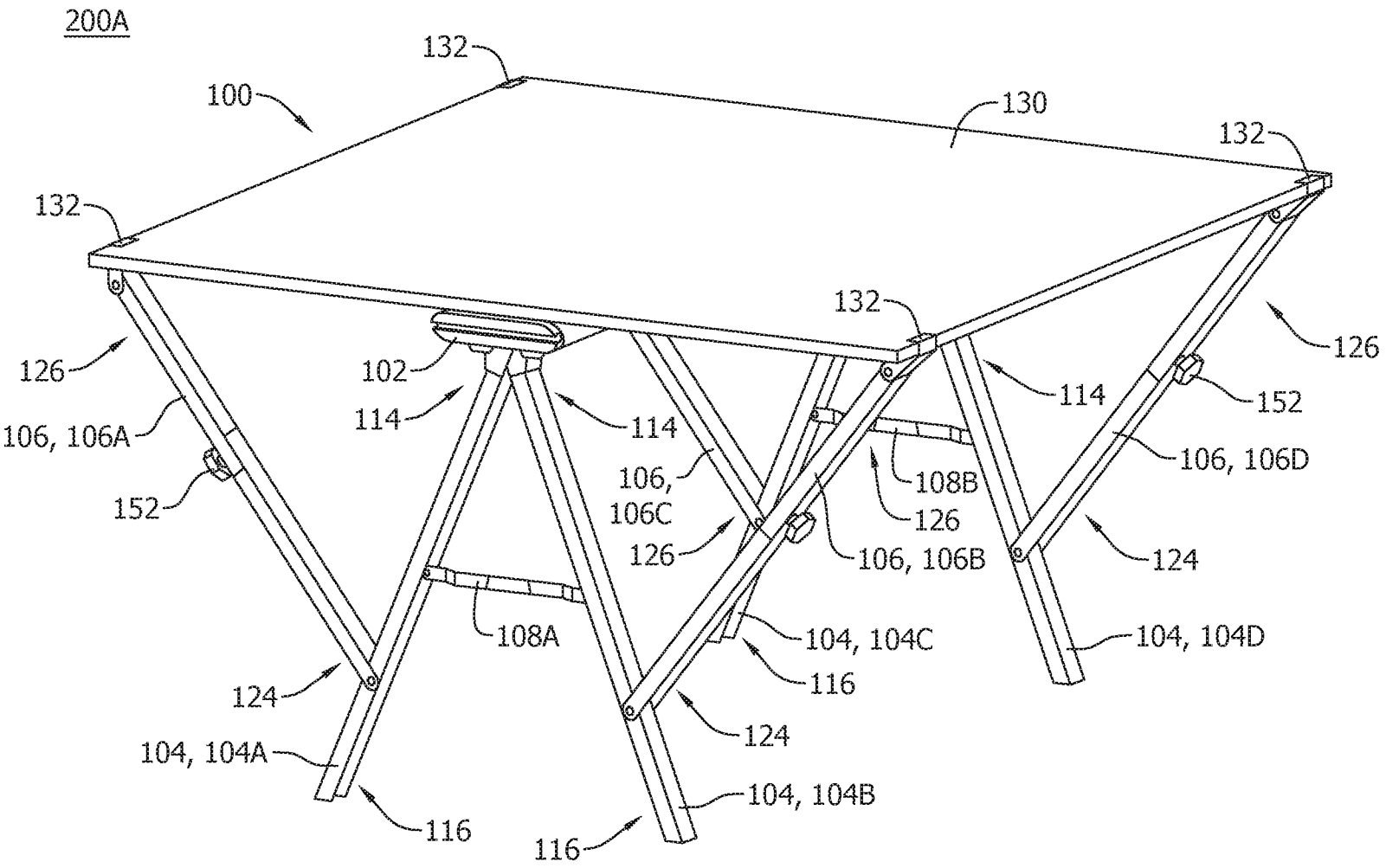
FIGS. 2A-2B illustrate various views of the apparatus designed for use as a sawhorse with a tabletop in accordance with embodiments of the present disclosure.
Figure 2B:
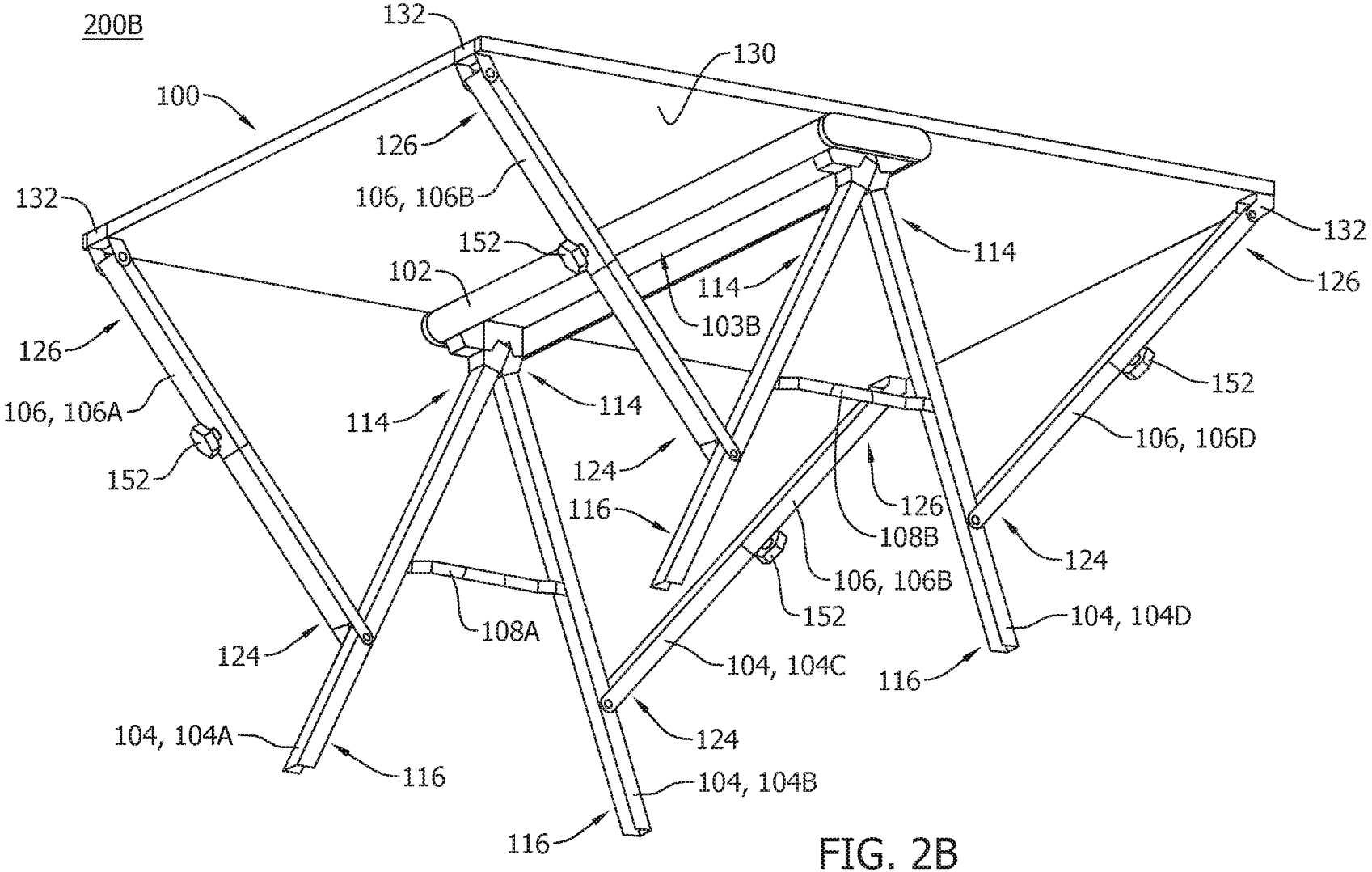
Figure 3B:
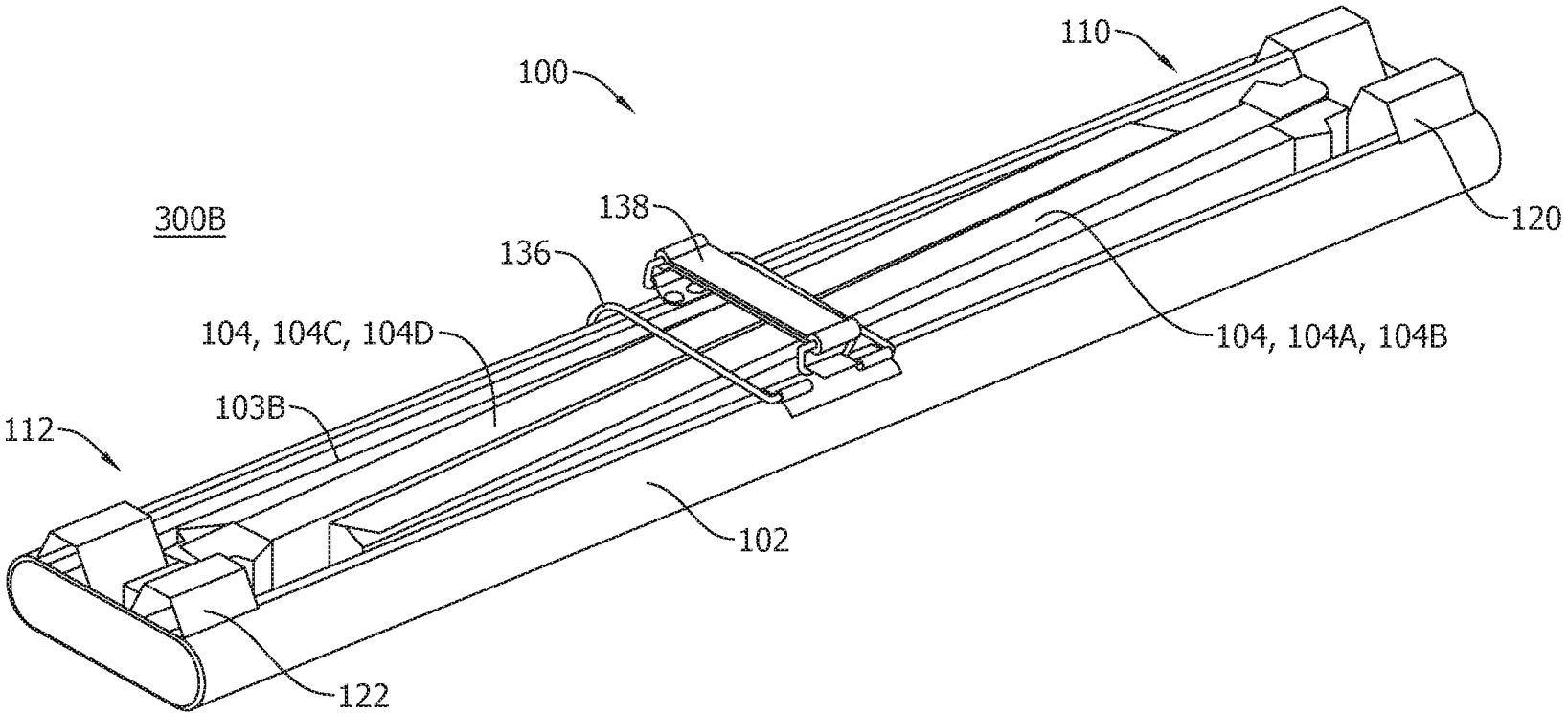

The apparatus 100 includes multiple arm members 106 rotatably coupled to the multiple leg members 104 so as to move between a deployed position (e.g., as shown in FIGS. 2A, 2B) and a retracted position (as shown in FIG. 1). The multiple arm members 106 may telescopically compress (or shorten, compact) in a first direction (e.g., toward the leg members 104) so as to slidably retract from the deployed position to the retracted position. The multiple arm members 106 may telescopically expand (or lengthen, enlarge) in another second direction (e.g., away from the leg members 104), that is opposite the first direction, so as to slidably extend from the retracted position to the deployed position.

The multiple leg members 104 include a first pair of leg members 104A, 104B rotatably coupled to a first end 110 of the elongated support member 102. The first pair of leg members 104A, 104B may collapse and retract from the open position to the closed position so as to nest (or fold) within the recess 103B of the elongated support member 102 (e.g., as shown in FIGS. 3A, 3B). The first pair of leg members 104A, 104B are hinged together so as to move between a closed position when retracted and an open position having an A-frame shape when deployed (e.g., as shown in FIGS. 2A, 2B). The first pair of leg members 104A, 104B are coupled to the elongated support member 102 so as to rotate about a first pivot point 120 disposed at the first end 110 of the elongated support member 102 (e.g., as shown in FIGS. 3A, 3B). The first pivot point 120 may be embodied as a first bracket coupled to the first end 110 of the elongated support member 102. The first bracket may allow the first pair of leg members 104A, 104B to rotate between the open position and the closed position at an angle.

When in the deployed position, the first pair of leg members 104A, 104B may include a first collapsible support member 108A that is used to maintain a separation distance between first leg member 104A and the second leg member 104B (as shown in FIG. 1). The first collapsible support member 108A is rotatably coupled to the first pair of leg members 104A, 104B so as to move between an expanded position and a retracted position for deployment (FIG. 1) and retraction (FIG. 3A, 3B), respectively.

The multiple leg members 104 include a second pair of leg members 104C, 104D rotatably coupled to a second end 112 of the elongated support member 102. The second pair of leg members 104C, 104D may expand and deploy from the closed position to the open position so as to extend from the recess 103B of elongated support member 102 102 (e.g., as shown in FIGS. 3A, 3B). The second pair of leg members 104C, 104D are hinged together so as to move between a closed position when retracted and an open position having an A-frame shape when deployed (e.g., as shown in FIGS. 2A, 2B). The second pair of leg members 104C, 104D are coupled to the elongated support member 102 so as to rotate about a second pivot point 122 disposed at the second end 112 of the elongated support member 102. The second pivot point 122 may be embodied as a second bracket coupled to the second end 112 of the elongated support member 102. The second bracket may allow the second pair of leg members 104C, 104D to rotate between the open position and the closed position at an angle.

When in the deployed position, the second pair of leg members 104C, 104D may include another second collapsible support member 108B that is used to maintain a separation distance between third leg member 104C and the fourth leg member 104D (as shown in FIG. 1). The second collapsible support member 108B is rotatably coupled to the second pair of leg members 104C, 104D so as to move between expanded and retracted positions for deployment (FIG. 1) and retraction (FIG. 3A, 3B), respectively.

The multiple leg members 104 include a first leg member 104A, a second leg member 104B, a third leg member 104C, and a fourth leg member 104D. The multiple arm members 106 include a first arm member 106A, a second arm member 106B, a third leg member 106C, and a fourth leg member 106D. Each leg member 104A, 104B, 104C, 104D of the multiple leg members 104 includes a first end 114 coupled to the elongated support member 102 and a second end 116 disposed distally opposite to the first end 114. Each leg member 104A, 104B, 104C, 104D of the multiple leg members 104 may correspond to each arm member 106A, 106B, 106C, 106D of the multiple arm members 106. For instance, the first arm member 106A is rotatably coupled (or hinged) to the first leg member 104A, the second arm member 106B is rotatably coupled (or hinged) to the second leg member 104B, the third arm member 106C is rotatably coupled (or hinged) to the third leg member 104C, and the fourth arm member 106D is rotatably coupled (or hinged) to the fourth leg member 104D (e.g., as shown in FIGS. 1, 2A, 2B).

Each arm member 106A, 106B, 106C, 106D of the multiple arm members 106 is rotatably hinged to the second end 116 of a corresponding leg member 104A, 104B, 104C, 104D of the multiple leg members 104 so as to rotate between an outwardly extended position away (e.g., as shown in FIGS. 2A-2B) from the corresponding leg member 104A, 104B, 104C, 104D and an inwardly adjacent position proximate (e.g., as shown in FIG. 1) to the corresponding leg member 104A, 104B, 104C, 104D. Each arm member 106A, 106B, 106C, 106D may include a rotating securing knob 152 that holds, locks, and secures each arm member 106A, 106B, 106C, 106D in the outwardly extended position.

FIGS. 2A-2B illustrate various views of the apparatus 100 designed for use as a sawhorse with a tabletop 130 in accordance with various embodiments of the present disclosure. In particular, FIG. 2A illustrates a top view 200A of the apparatus 100 having the tabletop 130 securely coupled thereto, and FIG. 2B illustrates a bottom view 200B of the apparatus 100 having the tabletop 130 securely coupled thereto.

As shown in FIGS. 2A-2B, the apparatus 100 may be embodied as a device or tool for supporting the tabletop 130. The apparatus 102 includes the elongated support member 102 as a horizontal sawhorse beam having the recess 103B. The apparatus 100 may be arranged and/or configured to hold, secure, and support the tabletop 130. In some examples, the tabletop 130 may be embodied as any type of wood-based planar structure, such as, e.g., a sheet of plywood or any other type of wood board, plank, etc. In other examples, the tabletop 130 may be embodied as any type of metal-base planar structure, such as, e.g., a sheet of metal or any other type of metal plate, etc.

The first pair of collapsible legs (or leg members) 104A, 104B are coupled to the first end 110 of the horizontal sawhorse beam 102. The first pair of collapsible legs (or leg members) 104A, 104B include a first pair of telescoping arms (or arm members) 106A, 106B that extend outward to support the tabletop 130 with the clamps 132 secured to the tabletop 130. As shown in FIGS. 2A-2B, the first pair of telescoping arms 106A, 106B may be extended and deployed to hold, secure, and support corner parts or portions of the tabletop 130 so as to provide a flat, level, planar working surface thereon.

The second pair of collapsible legs (or leg members) 104C, 104D are coupled to the second end 112 of the horizontal sawhorse beam 102. The second pair of collapsible legs (or leg members) 104C, 104D include the second pair of telescoping arms (or arm members) 104C, 104D that extend outward to support the tabletop 130 with the clamps 132 secured to the tabletop 130. As shown in FIGS. 2A-2B, the second pair of telescoping arms 106C, 106D may be extended and deployed to hold, secure, and support corner parts or portions of the tabletop 130 so as to provide a flat, level, planar working surface thereon.

Each arm member 106A, 106B, 106C, 106D of the multiple arm members 106 includes a first end 124 coupled to the second end 116 of a corresponding leg member 104A, 104B, 104C, 104D of the multiple leg members 104. Each arm member 106A, 106B, 106C, 106D of the multiple arm members 106 includes a second end 126 having a clamp 132 for securing the tabletop 130 to the apparatus 100. As shown in FIGS. 2A-2B, the each of the telescoping arms 106A, 106B, 106C, 106D may be extended and deployed to hold, secure, and support corner parts or portions of the tabletop 130 with the clamps 132 so as to provide a flat, level, planar working surface thereon. Further scope and detail related to the clamps 132 is provided herein in reference to FIGS. 4A-4C.

In some cases, the multiple leg members 104 may serve to raise and support the elongated support member 102 at some height above ground level. Each of the plurality of leg members 104 may be rotatably attached, fastened, or coupled to the ends 110, 112 and/or sides of the elongated support member 102 with rivets, bolts, screws, and/or various other fastening means via the first and second pivot points (or first and second brackets) 120, 122. In some cases, each of the leg members 104 may be disposed at ends 100, 112 of the elongated support member 102, e.g., with first and second pairs of leg members 104 at each end 110, 112. Further, fasteners may be used and may include screws (e.g., sheet metal screws, nuts and bolt combinations, etc.) that may be used to rotatably attach, fasten, or couple each of the first and second pairs of leg members 104 to the elongated support member 102. Each of the leg members 104 may be formed of a rigid material, such as, e.g., wood, metal, polymer, or various combinations thereof. For instance, the leg members 104 may be formed of a sheet metal or some other formed metal material.

In some cases, the apparatus 100 may be fabricated with a singular piece of material that is formed to shape a framework of the elongated support member 102. The apparatus 100 may be formed of a durable and rigid material. For instance, the apparatus 100 may be formed of metal, such as, but not limited to steel, stainless steel, chromoly steel, iron, aluminum, various metal alloys, or various other types of metals. In some cases, the singular piece of material may include a single piece of sheet metal. In other instances, the apparatus 100 may be formed of polymer, such as, but not limited to rigid polymers, polycarbonate, or various other types of polymer based materials, including thermoplastic polymers. The end caps 140, 142 may be attached, fastened, or coupled to the ends 110, 112 and/or sides of the elongated support member 102 with rivets, bolts, screws, welding, and/or various other fastening means. Also, fasteners may be used and may include screws (e.g., sheet metal screws, nuts and bolt combinations, etc.) that may be used to attach, fasten, or couple the end caps 140, 142 to the elongated support member 102.

FIGS. 3A-3B illustrates various views of the apparatus 100 designed for use as a sawhorse with nested legs (or leg members) 104 in accordance with embodiments of the present disclosure. In particular, FIG. 3A illustrates a perspective bottom view 300A of the apparatus 100 with nested legs (or leg members) 104, and FIG. 3B illustrates another perspective bottom view 300B of the apparatus 100 with nested leg members 104.

As shown in FIG. 3A, the elongated support member 102 may be embodied as a horizontal sawhorse beam having the bottom-side with the recess 103B formed therein so as to nest the multiple leg members 104. As shown, the multiple leg members 104 are rotatably coupled to the elongated support member 102 so as to move between an open position and a closed position. For example, as shown, the multiple leg members 104 may collapse and retract from the open position to the closed position so as to nest (or fold) within the recess 103B of the elongated support member 102.

As shown in FIG. 3B, the apparatus 100 may include a J-wire 136 coupled to the elongated support member 102 so as to secure the multiple legs members 104 within the recess 103B when the multiple leg members 104 are retracted (or folded) in the closed position and nested within the recess 103B. As also shown in FIG. 3B, the apparatus 100 may include a strap 138 detachably coupled to the elongated support member 102 so as to provide a handle for carrying the apparatus 100 when the strap 138 is attached and to provide access to the nested multiple leg members 104 when the strap 138 is detached.

As shown in FIGS. 3A-3B, the first pivot point 120 may be embodied as a first bracket coupled to the first end 110 of the elongated support member 102. The first bracket may be a U-shaped stamped metal hinge that allows the first pair of leg members 104A, 104B to rotate (or pivot) between the open and closed positions at an angle. In some instances, the angle of rotation allows correct (or proper) positioning of the first pair of leg members 104A, 104B when deployed to the open position. In some other instances, the angle of rotation also allows correct (or proper) positioning of the first pair of leg members 104A, 104B when retracted to the closed position.

Similarly, as shown in FIGS. 3A-3B, the second pivot point 122 may be embodied as a second bracket coupled to the second end 112 of the elongated support member 102. As with the first bracket, the second bracket may also be a U-shaped stamped metal hinge that allows the second pair of leg members 104C, 104D to rotate (or pivot) between the open and closed positions at an angle. In some instances, the angle of rotation allows correct (or proper) positioning of the second pair of leg members 104C, 104D when opened to the deployed position. In some other instances, the angle of rotation also allows correct (or proper) positioning of the second pair of leg members 104C, 104D when retracted to the closed position.

Figure 4A:
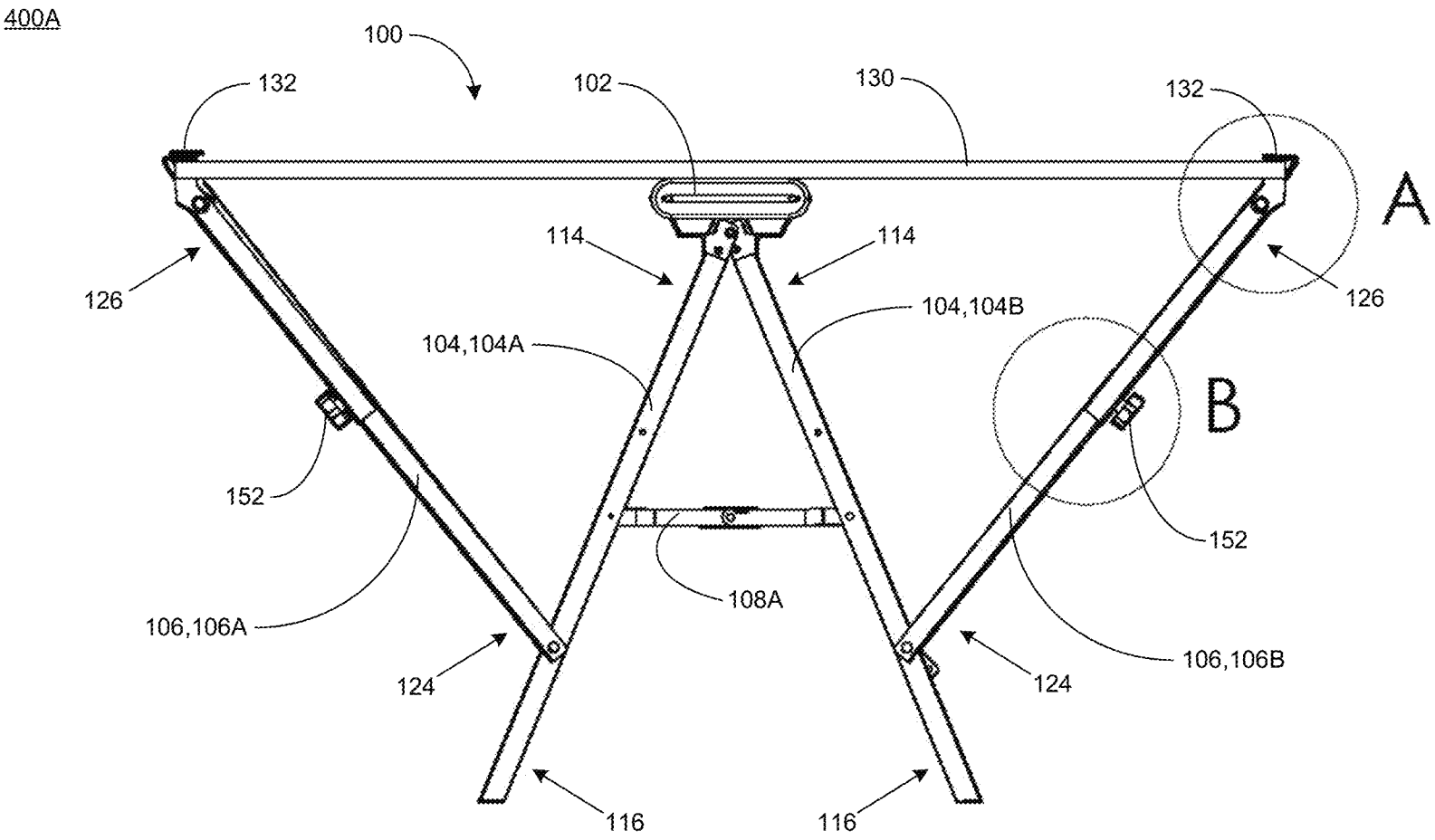
FIGS. 4A-4C illustrate various views of the apparatus designed for use as a sawhorse with a tabletop in accordance with embodiments of the present disclosure.
Figure 4C:
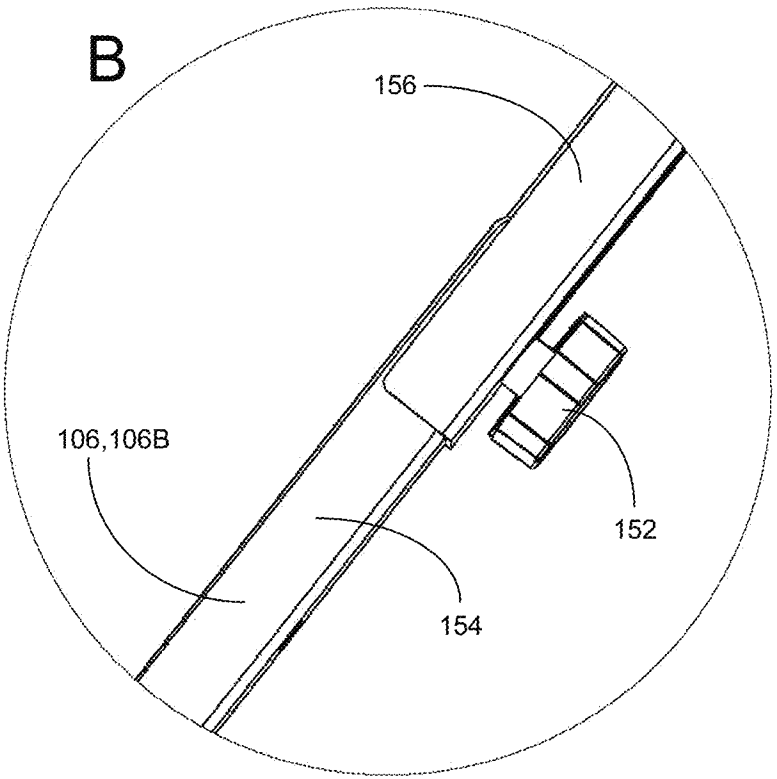
Figure 4B:
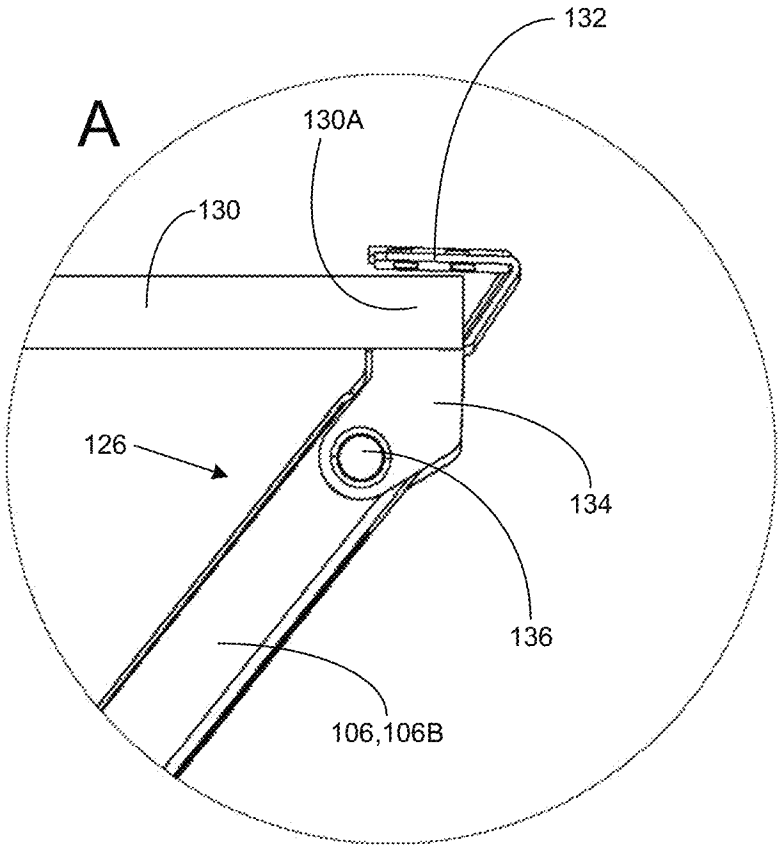

FIGS. 4A-4C illustrate various views of the apparatus 100 designed for use as a sawhorse with a tabletop 130 in accordance with various embodiments of the present disclosure. In particular, FIG. 4A illustrates a side view 400A of the apparatus 100 with the tabletop 130, FIG. 4B illustrates a side view 400B of the clamp 132, and FIG. 4C illustrates a side view 400C of the securing knob 152.

As shown in FIG. 4A, the multiple leg members 104 are rotatably coupled to the elongated support member 102 so as to move between an open position and a closed position. As shown, the multiple leg members 104 may expand and deploy from the closed position to the open position so as to extend from the recess 103B of the elongated support member 102. Further, the multiple arm members 106 are rotatably coupled to the multiple leg members 104 so as to move between a deployed position and a retracted position. As shown, the multiple arm members 106 telescopically expand so as to slidably extend from the retracted position to the deployed position. Each arm member 104 includes the first end 124 coupled to the second end 116 of a corresponding leg member 104, and each arm member 106 includes the second end 126 having the clamp 132 for holding, fastening, and securing the tabletop 130 to the elongated support member 102 of the apparatus 100. The clamp 132 may also be referred to as a clip, catch or clasp.

FIG. 4A includes a first circular cutline A and a second cutline B. As shown in FIG. 4B, the first circular cutline A refers to a side view of the clamp 132. In some instances, the clamp 132 is embodied as a C-clamp type structure having a base portion 134 that is coupled to the second end 126 of the arm member 106 so as to rotate via a third pivot point 136. The clamp 132 rotates into a position as shown in FIG. 4B so as to couple with (or wrap around) an edge 130A of the tabletop 130. The clamp 132 may be formed of a durable and rigid material and have a spring type elasticity and resilience for flexible operative characteristics. For instance, the clamp 132 may be formed of metal, such as, but not limited to steel, stainless steel, chromoly steel, iron, aluminum, various metal alloys, or various other types of metals. In other instances, clamp 132 may be formed of polymer, such as, but not limited to rigid polymers, polycarbonate, or various other types of polymer based materials, including thermoplastic polymers.

As shown in FIG. 4C, the second circular cutline B refers to a side view of the securing knob 152. In some instances, the securing knob 152 is embodied as a rotating threaded clamp type structure that couples with threads formed in a first telescoping part 154 of the arm member 104 so as to securely tighten with a second telescoping part 156 of the arm member 106. During deployment and retraction of the arm member 106, the first telescoping part 154 slidably engages with the second telescoping part 156 so as to move between the expanded position and the retracted position. Once the arm member 106 is deployed, the securing knob 152 may be rotatably tightened to securely fasten the first and second telescoping parts 154, 156 together in the deployed position. The securing knob 152 may be formed of a durable and rigid material. For instance, the securing knob 152 may be formed of metal, such as, but not limited to steel, stainless steel, chromoly steel, iron, aluminum, various metal alloys, or various other types of metals. The securing knob 152 may be formed of polymer, such as, but not limited to rigid polymers, polycarbonate, or various other types of polymer based materials, including thermoplastic polymers.

Figure 5B:
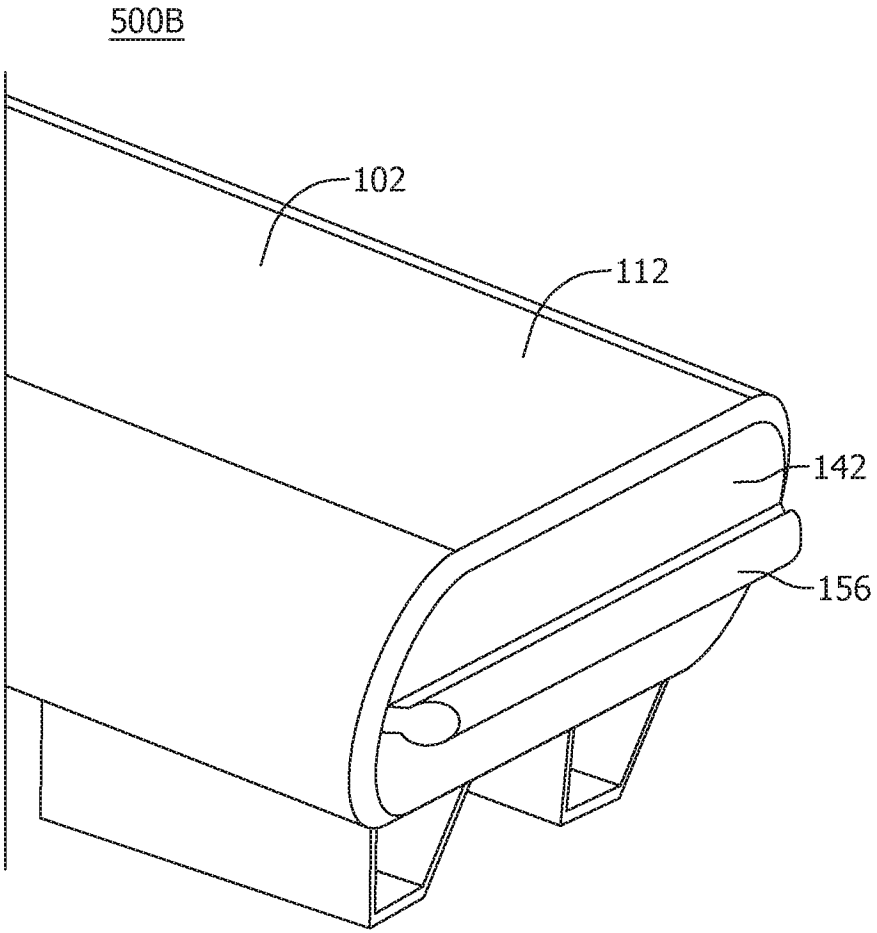
FIGS. 5A-5B illustrate various views of the apparatus designed for use as a sawhorse with slotted end caps in accordance with embodiments of the present disclosure.
Figure 5A:
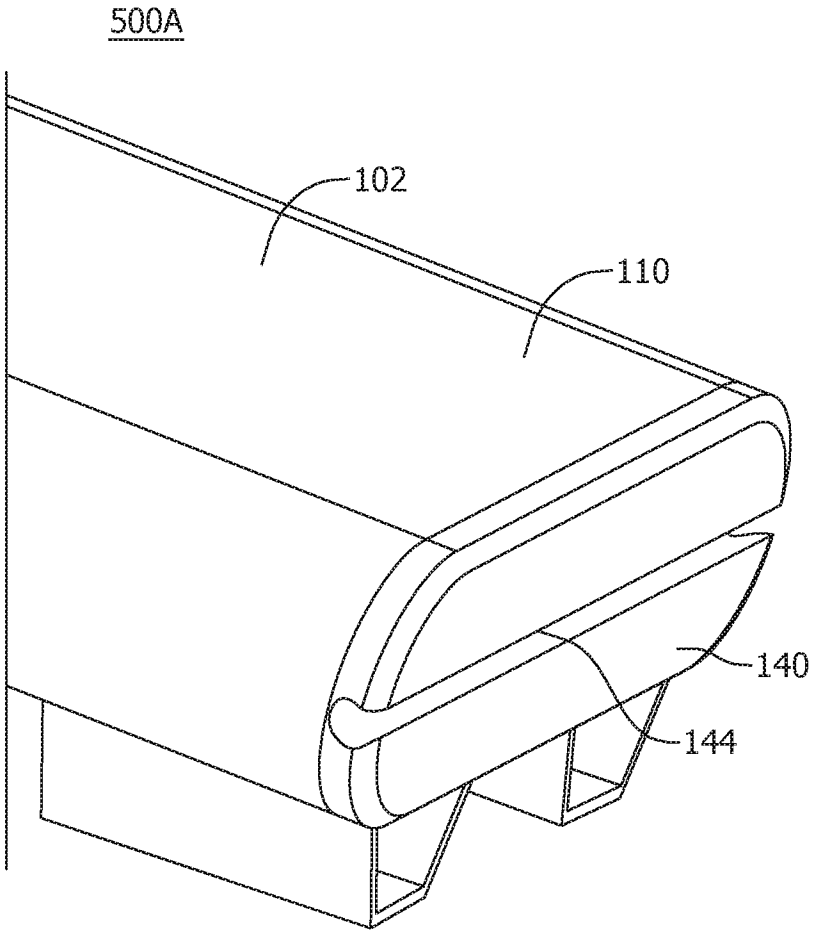

FIGS. 5A-5B illustrate various views of the apparatus 100 designed for use as a sawhorse with slotted end caps 140, 142 in accordance with various embodiments of the present disclosure. In particular, FIG. 5A illustrates a perspective view 500A of the first end cap 140 with a slotted key-hole recess 144, and FIG. 5B illustrates the second end cap 142 with a slotted key-hole protrusion 146.

As shown in FIGS. 5A-5B, the elongated support member 102 includes the multiple end caps 140, 142 including a first end cap 140 coupled to a first end 110 of the elongated support member 102 and a second end cap 142 coupled to a second end 112 of the elongated support member 102. The first end cap 140 includes a slotted key-hole recess 144, and the second end cap 142 includes a slotted key-hole protrusion 146 that slidably joins with the slotted key-hole recess 144.

Figure 6A:
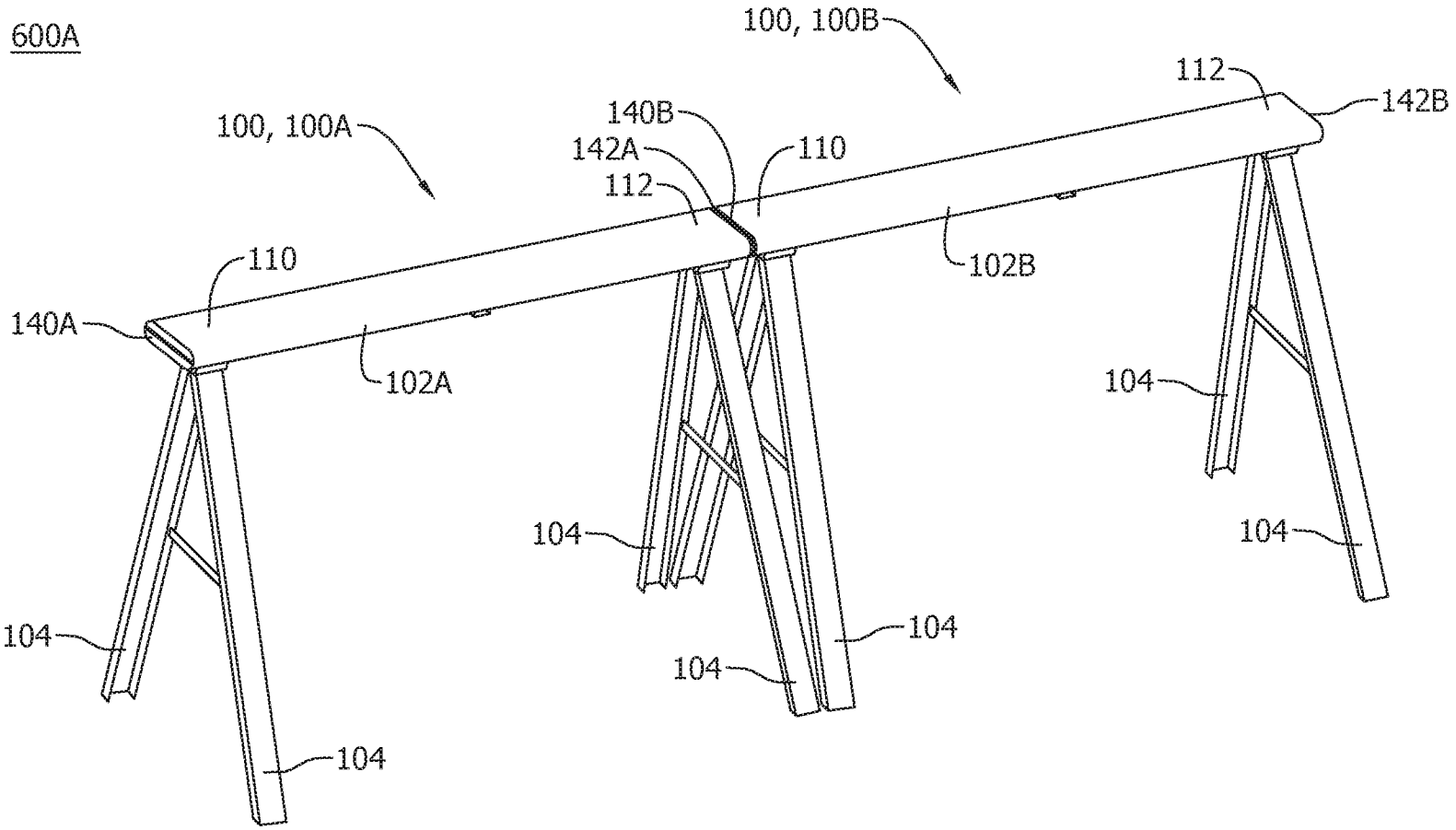

FIGS. 6A-6B illustrate various views of multiple apparatuses 100A, 100B designed for use as conjoined sawhorses in accordance with embodiments of the present disclosure. In particular, FIG. 6A illustrates a top view 600A of the apparatuses 100A, 100B conjoined together, and FIG. 6B illustrates a bottom view 600B of the apparatuses 100A, 100B conjoined together.

As shown in FIGS. 6A-6B, the elongated support members (or horizontal sawhorse beams) 102A, 102B may include the multiple end caps 140A, 140B, 142A, 142B including the first end caps 140A, 140B coupled to first ends 110 of the horizontal sawhorse beams 102A, 102B and the second end caps 142A, 142B coupled to the second ends 112 of the horizontal sawhorse beams 102A, 102B. As shown and described in reference to FIGS. 5A-5B, each of the first end caps 140A, 140B include the slotted key-hole recesses 144, and each of the second end caps 142 include the slotted key-hole protrusions 146.

In some embodiments, the first slotted key-hole recess 144 of the first end cap 142A of the horizontal sawhorse beam 102A of the apparatus 100A may be adapted to slidably join a second slotted key-hole protrusion 146 of the second end 140B of the adjacent horizontal sawhorse beam 102B of the adjacent apparatus 100B. Although not shown, three apparatuses 100 may be conjoined together such that the first slotted key-hole protrusion 146 of the second end cap 142 may be adapted to slidably join the second slotted key-hole recess 144 of another adjacent horizontal sawhorse beam 102 of another adjacent apparatus 100 (e.g., a third apparatus).

Figure 7:
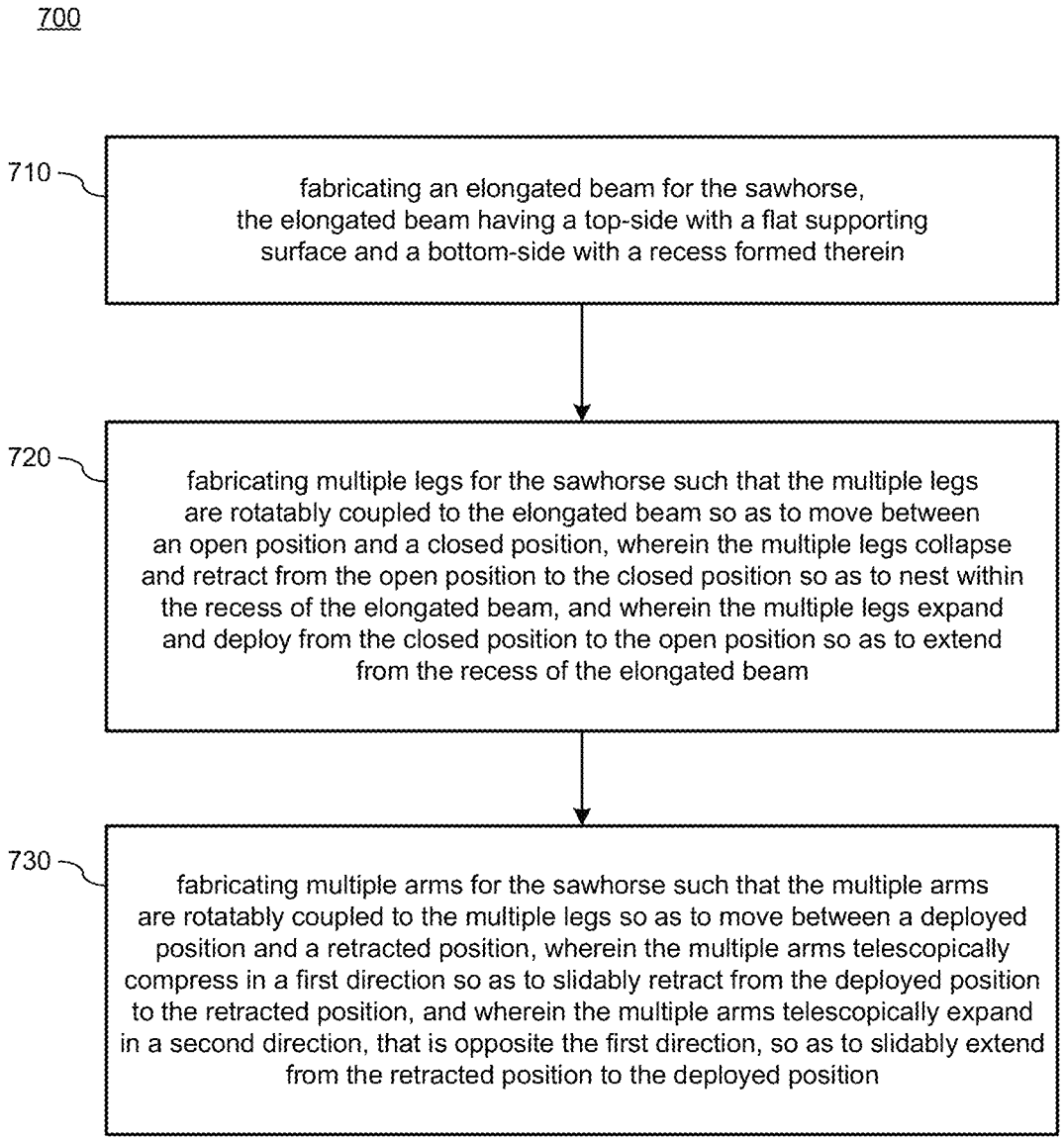
FIG. 7 illustrates a process flow diagram of a method for manufacturing an apparatus as a sawhorse in accordance with embodiments of the disclosure.

FIG. 7 illustrates a process flow diagram of a method for manufacturing an apparatus as a sawhorse in accordance with embodiments of the disclosure.

It should be understood that while method 700 indicates a particular order of execution of operations, in some examples, certain portions of the operations might be executed in a different order, and on different systems. In other examples, one or more additional operations and/or steps may be added to method 700. Similarly, some operations and/or steps may be omitted. Further, in reference to method 700 of FIG. 7, steps 710-730 are described with reference to FIGS. 1-6B.

In some implementations, method 700 of FIG. 7 may refer to a method of fabricating and/or manufacturing an apparatus, device, tool or system for use as a sawhorse, including a sawhorse for supporting a tabletop. For instance, at block 710, method 700 may fabricate an elongated beam for the sawhorse. The elongated beam may have a top-side with a flat supporting surface and a bottom-side with a recess formed therein.

At block 720, method 700 may fabricate multiple legs for the sawhorse such that the multiple legs are rotatably coupled to the elongated beam so as to move between an open position and a closed position. The multiple legs collapse and retract from the open position to the closed position so as to nest within the recess of the elongated beam. The multiple legs expand and deploy from the closed position to the open position so as to extend from the recess of the elongated beam.

At block 730, method 700 may fabricate multiple arms for the sawhorse such that the multiple arms are rotatably coupled to the multiple legs so as to move between a deployed position and a retracted position. The multiple arms telescopically compress in a first direction so as to slidably retract from the deployed position to the retracted position. The multiple arms telescopically expand in a second direction, that is opposite the first direction, so as to slidably extend from the retracted position to the deployed position.

Figure 8A:
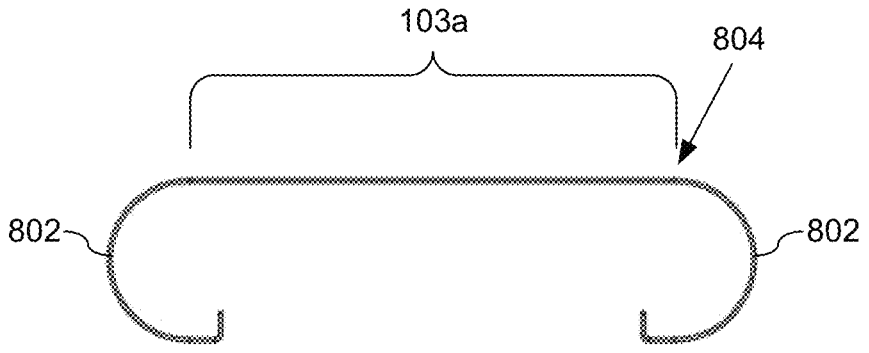
FIGS. 8*a*-8*c* illustrate various cross-section diagrams of the horizontal saw horse beam in accordance with embodiments of the present disclosure.
Figure 8B:
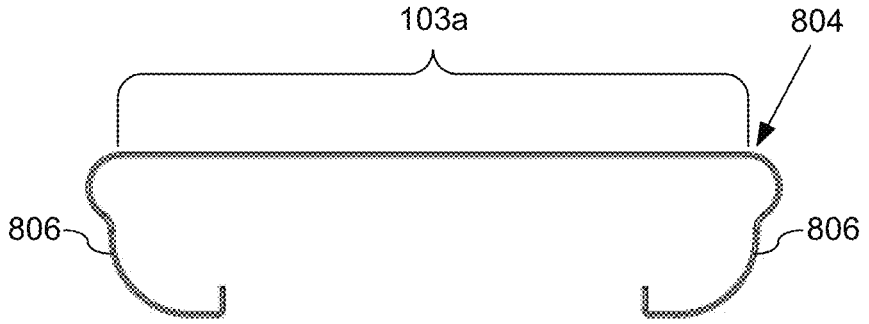
Figure 8C:
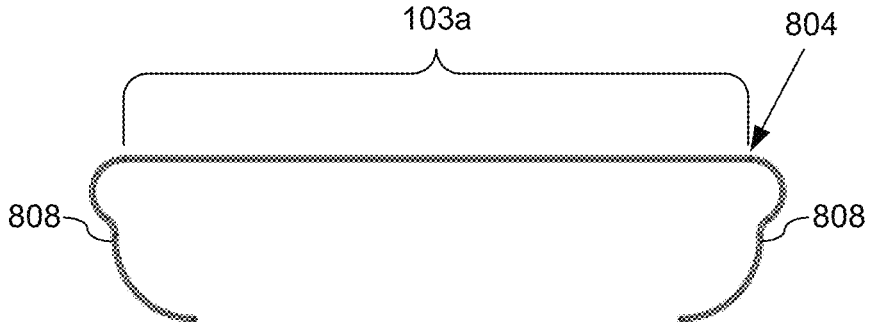

FIGS. 8*a*-8*c* illustrate various cross-section diagrams of the horizontal saw horse beam in accordance with embodiments of the present disclosure. In particular, FIG. 8*a* depicts a cross-section of the horizontal saw horse beam 102 described above with respect to FIGS. 1-7. The horizontal saw horse beam 102 comprises the flat supporting surface 103*a* and curved side portions 802. The flat supporting surface 103*a*, in one embodiment is planar and extends a distance of between 2 and 12 inches between opposing transitions and curved side portions 802. The transition 804 between either of the side portions 802 and the flat supporting surface 103*a* is continuous. As used herein, the term "continuous" refers to a transition between the planar flat supporting surface 103*a* and a side 802 that does not contain a sharp angular transition.

FIGS. 8*b* and 8*c* depict alternative embodiments of a flat supporting surface 103*a* and a curved side portion 804, 806 and a transition that is continuous, or not angular. The side portions 806, 808 of the embodiments of FIGS. 8*a*-8*c* are configured to receive, in some embodiments, a power tool mount. One example of a power tool mount is a miter saw bracket as described below with reference to FIG. 9.

Figure 9:
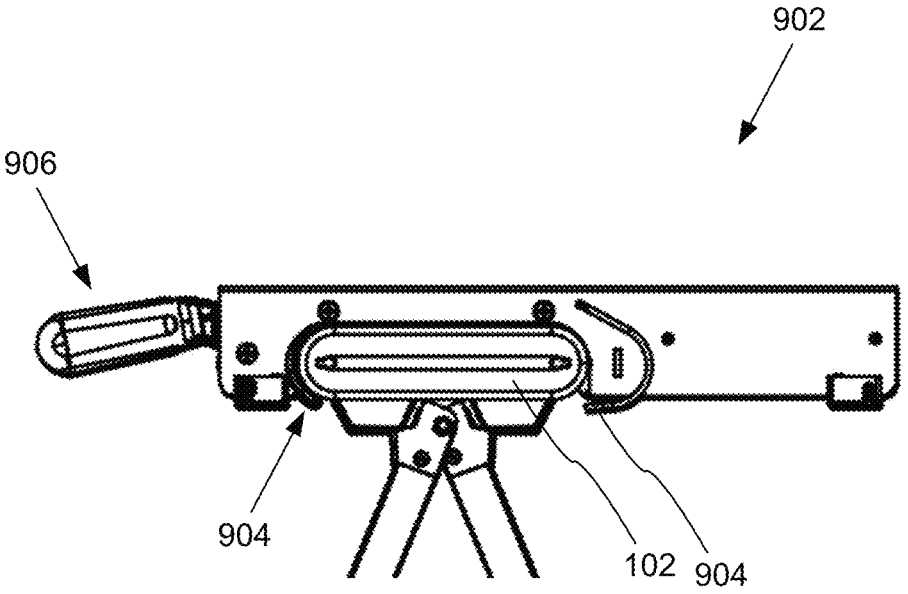
FIG. 9 is a side view diagram illustrating an embodiment of a sawhorse with a power tool bracket in accordance with embodiments of the present disclosure.

FIG. 9 is a side view diagram illustrating an embodiment of a sawhorse with a power tool bracket in accordance with embodiments of the present disclosure. The power tool bracket 902, in some embodiments, is configured to engage the horizontal sawhorse beam 102. Curved engaging portions 904 engage curved side portions of the horizontal sawhorse beam 102. The horizontal sawhorse beam 102 may include any number of different variations of curved side portions, a few non-limiting examples of which are described above with respect to FIGS. 8*a*-8*c*.

The power tool bracket 902, in some embodiments, may include a handle 906 for activating the engaging portions 904 of the bracket 902. The handle 906 is configured to extend and/or retract at least one of the curved engaging portions with respect to the opposing curved engaging portion. The power tool bracket 902 is configured to support a power tool, such as a miter saw.

In the above description, numerous details are set forth. It will be apparent, however, to one skilled in the art, that the present disclosure may be practiced without these specific details. In some instances, well-known structures and devices are shown in block diagram form, rather than in detail, in order to avoid obscuring the present disclosure.

Generally, it is to be understood that the above description is intended to be illustrative, and not restrictive. Many other embodiments may be apparent to those of skill in the art upon reading and understanding the above description. Although the present disclosure has been described with reference to specific exemplary embodiments, it will be recognized that the present disclosure is not limited to the embodiments described, but can be practiced with modification and alteration within the spirit and scope of the appended claims. Accordingly, the specification and drawings are to be regarded in an illustrative sense rather than a restrictive sense. Therefore, the scope of the present disclosure be determined with reference to the appended claims, along with the full scope of equivalents to which such claims are entitled.

What is claimed is:

1. An apparatus, comprising:

an elongated support member having a recess;

multiple leg members rotatably coupled to the elongated support member so as to move between an open position and a closed position, wherein the multiple leg members collapse and retract from the open position to the closed position so as to nest within the recess of the elongated support member, wherein the multiple leg members expand and deploy from the closed position to the open position so as to extend from the recess of the elongated support member, and wherein each leg member of the multiple leg members includes a first end coupled to the elongated support member and a second end disposed distally opposite to the first end; and multiple arm members that are each rotatably pinned to the second end of a corresponding leg member of the multiple leg members so as to move between an outwardly extended position away from the corresponding leg member and an inwardly adjacent position proximate to the corresponding leg member, wherein the multiple arm members telescopically compress in a first direction so as to slidably retract from a deployed position to a retracted position, and wherein the multiple arm members telescopically expand in a second direction, that is opposite the first direction, so as to slidably extend from the retracted position to the deployed position, wherein the elongated support member comprises multiple end caps including a first end cap coupled to a first end of the elongated support member and a second end cap coupled to a second end of the elongated support member, and wherein the first end cap comprises a slotted key-hole recess, and wherein the second end cap comprises a slotted key-hole protrusion that slidably joins with the slotted keyhole recess.

2. The apparatus of claim 1, wherein the elongated support member comprises a horizontal sawhorse beam having a top-side with a flat supporting surface and a bottom-side with the recess formed therein.

3. The apparatus of claim 1, wherein the multiple leg members include a first pair of leg members rotatably coupled to a first end of the elongated support member, and wherein the first pair of leg members collapse and retract from the open position to the closed position so as to nest within the recess of the elongated support member.

4. The apparatus of claim 3, wherein the first pair of leg members are hinged together so as to move between a closed position when retracted and an open position having an A frame shape when deployed.

5. The apparatus of claim 3, wherein the first pair of leg members are coupled to the elongated support member so as to rotate about a first pivot point disposed at the first end of the elongated support member, and wherein the first pivot point comprises a first bracket coupled to the first end of the elongated support member, and wherein the first bracket allows the first pair of leg members to rotate between the open position and the closed position at an angle.

6. The apparatus of claim 3, wherein the multiple leg members include a second pair of leg members rotatably coupled to a second end of the elongated support member, and wherein the second pair of leg members expand and deploy from the closed position to the open position so as to extend from the recess of elongated support member.

7. The apparatus of claim 6, wherein the second pair of leg members are hinged together so as to move between a closed position when retracted and an open position having an A-frame shape when deployed.

8. The apparatus of claim 6, wherein the second pair of leg members are coupled to the elongated support member so as to rotate about a second pivot point disposed at the second end of the elongated support member, and wherein the second pivot point comprises a second bracket coupled to the second end of the elongated support member, and wherein the second bracket allows the second pair of leg members to rotate between the open position and the closed position at an angle.

9. The apparatus of claim 1, wherein each arm member of the multiple arm members includes a first end coupled to the second end of the corresponding leg member of the multiple leg members, and wherein each arm member of the multiple arm members includes a second end having a clamp for securing a tabletop supported by the elongated support member.

10. The apparatus of claim 1, further comprising a J-wire coupled to the elongated support member so as to secure the multiple legs members within the recess when the multiple leg members are retracted in the closed position and nested within the recess.

11. The apparatus of claim 1, further comprising a strap detachably coupled to the elongated support member so as to provide a handle for carrying the apparatus when the strap is attached and to provide access to the nested multiple leg members when the strap is detached.

12. An apparatus for supporting a tabletop, the apparatus comprising:

a horizontal sawhorse beam having a recess;

a first pair of collapsible legs coupled to a first end of the horizontal sawhorse beam, the first pair of collapsible legs having a first pair of telescoping arms, each of the first pair of telescoping arms being coupled at a first end to a corresponding leg of the first pair of collapsible legs, a second end of each of the first pair of telescoping arms extending outward to support the tabletop, the second end of each of the first pair of telescoping arms comprising a clamp that selectively attaches to and detaches from edges of the tabletop; and a second pair of collapsible legs coupled to a second end of the horizontal sawhorse beam, the second pair of collapsible legs having a second pair of telescoping arms, each of the second pair of telescoping arms being coupled at a first end to a corresponding leg of the second pair of collapsible legs, a second end of each of the second pair of telescoping arms extending outward to support the tabletop, the second end of each of the second pair of telescoping arms comprising a clamp that selectively attaches to and detaches from edges of the tabletop, tabletop, wherein the horizontal sawhorse beam comprises multiple end caps including a first end cap coupled to a first end of the horizontal sawhorse beam and a second end cap coupled to a second end of the horizontal sawhorse beam, and wherein the first end cap comprises a first slotted key-hole recess, and wherein the second end cap comprises a first slotted key-hole protrusion, and wherein the first slotted key-hole recess of the first end cap is adapted to slidably join a second slotted key-hole protrusion of an adjacent horizontal sawhorse beam of an adjacent apparatus, and wherein the first slotted key-hole protrusion of the second end cap is adapted to slidably join a second slotted key-hole recess of another adjacent horizontal sawhorse beam of another adjacent apparatus.

13. The apparatus of claim 12, wherein the first and second pair of collapsible legs are rotatably coupled to the horizontal sawhorse beam so as to move between an open position and a closed position, and wherein the first and second pair of collapsible legs collapse and retract from the open position to the closed position so as to nest within the recess of the horizontal sawhorse beam, and wherein the first and second pair of collapsible legs expand and deploy from the closed position to the open position so as to extend from the recess of the horizontal sawhorse beam.

14. The apparatus of claim 12, wherein the first and second pairs of telescoping arms are rotatably coupled to the first and second pair of collapsible legs, respectively, so as to move between a deployed position and a retracted position, wherein the first and second pairs of telescoping arms telescopically compress in a first direction so as to slidably retract from the deployed position to the retracted position, and wherein the first and second pairs of telescoping arms telescopically expand in a second direction, that is opposite the first direction, so as to slidably extend from the retracted position to the deployed position.

* * * * *